United States Patent [19]

Onishi et al.

[11] 4,043,030

[45] Aug. 23, 1977

[54] PROCESS FOR PREPARING DISTRIBUTION ROTOR

[75] Inventors: Masayoshi Onishi, Himeji; Yoshinobu Aiyama, Johana, both of Japan

[73] Assignee: Mitsubishi Denki Kabushiki Kaisha, Tokyo, Japan

[21] Appl. No.: 710,329

[22] Filed: July 30, 1976

[51] Int. Cl.[2] ..... H01H 11/00

[52] U.S. Cl. ..... 29/622; 200/19 DR

[58] Field of Search ..... 29/622, 628; 200/19 DR, 200/19 DC; 264/272

[56] References Cited

U.S. PATENT DOCUMENTS

| | | | |
|---|---|---|---|
| 1,997,460 | 4/1935 | Fitzsimmons | 200/19 DR X |
| 2,593,205 | 4/1952 | Short et al. | 200/19 DR X |
| 2,678,365 | 5/1954 | Bales | 200/19 DR |
| 2,688,714 | 9/1954 | Buchmann | 200/19 DR |
| 2,772,372 | 11/1956 | Slick | 200/19 DR X |
| 2,790,020 | 4/1957 | Redick et al. | 200/190 DR X |
| 3,132,219 | 5/1964 | Kohler | 200/19 DR |
| 3,916,512 | 11/1975 | Sato et al. | 29/622 |
| 3,967,369 | 7/1976 | Takano | 29/622 |

*Primary Examiner*—James R. Duzan

*Attorney, Agent, or Firm*—Oblon, Fisher, Spivak, McClelland & Maier

[57] ABSTRACT

A distribution rotor is prepared by forming an electrode, having a central electrode part, an outer electrode part, and connecting parts, and fixing a resistor to both the central electrode part and the outer electrode part, subsequently severing and removing the connecting parts, and molding the assembly of the electrode and the resistor with a resin so as to form a one piece resin housing thereabout.

1 Claim, 4 Drawing Figures

PROCESS FOR PREPARING DISTRIBUTION ROTOR

BACKGROUND OF THE INVENTION

1. Field of the Invention

The present invention relates generally to distribution rotors, and more particularly to a distribution rotor used for an ignition distributor which distributes secondary high voltage to the ignition coil of an engine, and a process for preparing the same.

2. Description of the Prior Art

Heretofore, it has been considered to connect a resistor to a part of an electrode of a distribution rotor in order to prevent noise caused by the spark discharges between the cap and the distribution rotor used in the ignition distributor for an engine.

In the conventional process for preparing such a distribution rotor, the rotor is molded by using an epoxy resin which can form a molded product of high dimensional accuracy, and then the electrode parts, which are fixed to both ends of a resistor, are disposed within the mold under the base of the outer surface of the product to be molded. The variation of the relative position between the electrode and resistor is diminished by adjusting the the distance between the same by means of employing a longer central electrode part of the rotor, and subsequently, the epoxy resin is poured into the space so as to fix the electrode and the resistor at their relative positions within the rotor.

Accordingly, the process is quite complex, mass production has been difficult to attain, and the costs have been disadvantageously high.

SUMMARY OF THE INVENTION

Accordingly, it is an object of the present invention to provide a process for preparing a distribution rotor having a high dimensional accuracy by means of a simple operation.

Another object of the present invention is to provide a distribution rotor having a high dimensional accuracy without thermal strain or non-uniform stress.

Still another object of the present invention is to provide a process for preparing a distribution rotor, used for an ignition distributor for distributing secondary high voltage to an ignition coil of an engine, by an injection molding operation so as to improve the dimensional accuracy and workability thereof.

Yet another object of the present invention is to provide a process for preparing a distribution rotor, by mass production, by injection molding of a thermoplastic material, such as, for example, polypropylene.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference numerals designate like or corresponding parts throughout the several figures, and in which.

DETAILED DESCRIPTION OF A PREFERRED EMBODIMENT

Figure 1:
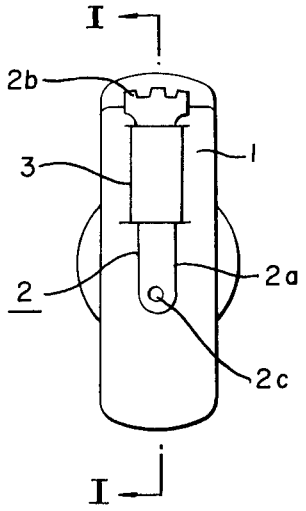
FIG. 1 is a plan view of a distribution rotor prepared by the process of the present invention.
Figure 2:
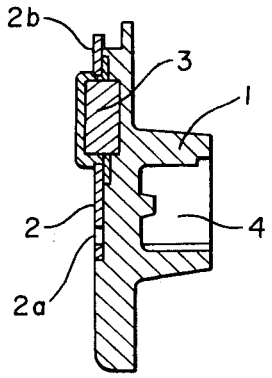
FIG. 2 is a sectional view of the rotor of FIG. 1 taken along the line 1—1 of FIG. 1.

Referring now to the drawings and more particularly to FIGS. 1 and 2 thereof, a rotor 1, molded from a suitable thermoplastic insulation material, such as, for example, polypropylene, includes an electrode 2, for distributing a secondary high voltage to the ignition plugs of an engine, mounted upon one surface thereof. Electrode 2 is seen to comprise a central electrode part *2a*, and an outer electrode part *2b*, an aperture *2c* being formed in the central electrode part *2a*. A resistor 3 is interposed between electrode 2 and rotor 1 within the upper region of the assembly, and a cylindrical part 4 of the rotor 1 is adapted to be fitted to a shaft of an ignition distributor.

Figure 3:
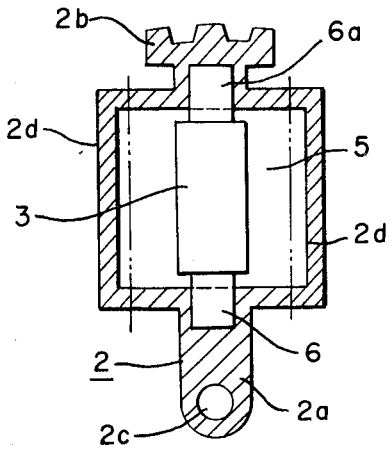
FIG. 3 is a sectional view of a part of the distribution rotor for illustrating part of the process of the present invention.
Figure 4:
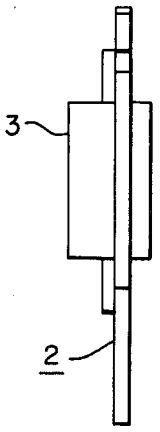
FIG. 4 is a side view of the part of FIG. 3.

Referring now to FIGS. 3 and 4, the process for preparing the distribution rotor will be described.

The electrode 2 is formed by means of a press-molding process so as to have a configuration wherein a rectangular recess 5 is provided therein, as defined by the upper portion of the central electrode part *2a*, the lower portion of the outer electrode part *2b*, and connecting parts *2d* provided for connecting together the central electrode part *2a* and the outer electrode part *2b*, the resistor 3 being fitted in such rectangular recess 5. Both ends of the resistor 3 are fixed to the joints 6 and *6a* of the electrode by means of spot welding, soldering, or the like, and subsequently, the connecting parts *2d* of the electrode, shown by the oblique cross lines are severed and removed, the parts *2d* normally having a rectangular configuration. The assembly of the electrode and the resistor is then placed in a mold, with the outer electrode part *2b* and the hole *2c* of the electrode 2 in predetermined positions of the mold, whereupon the thermoplastic material is injected so as to mold the same.

In summary, the electrode 2 is press-molded into its configuration whereby the central electrode part *2a* and the terminal electrode part *2b* are connected with the connecting parts *2d* so as to form the rectangular recess 5, and subsequently, the resistor 3 is fixed therein, whereby thermal strain and non-uniform stress caused by the spot welding or soldering for fixing the resistor 3 can be absorbed, and the dimensional accuracy of the electrode can be highly maintained, the electrode 2 also being accurately positioned within the mold for the injection molding operation so as to prevent the shifting of its position and to prevent dimensional changes without failure even though high temperatures such as, for example, within the range of 150° C – 200° C, and high pressures, of the order of 800 $Kg/cm^2$, for example, are imparted to the structure during the injection molding operation.

In accordance with the present invention, the electrode having the connecting parts for connecting the central electrode part and the outer electrode part is molded in one piece and the resistor is fixed between the central electrode part and the outer electrode part, and subsequently, the connecting parts of the electrode are severed and removed, and the combination of the electrode and the resistor is then molded in the thermoplastic material, whereby the operation is remarkably simple, the productivity can be considerably increased, and a distribution rotor having a high dimensional accuracy can be obtained with minimum costs expended.

Obviously, many modifications and variations of the present invention are possible in light of the above teachings. It is to be understood therefore that whithin the scope of the appended claims, the present invention may be practiced otherwise than as specifically described herein.

What is claimed as new and desired to be secured by letters patent of the united states is:

1. A process for preparing a distribution rotor comprising:

forming an electrode having an outer electrode part and a central electrode part joined together by a connecting part, joining through the application of heat a first end of a resistor to the central electrode part and joining through the application of heat a second end of the resistor to the outer electrode part, the connecting part absorbing the thermal strain and non-uniform stress caused by the application of heat, severing and removing the connecting part, and molding the assembly of the electrode and the resistor with a resin so as to form a one piece resin block.

* * * * *